US006561184B2

(12) United States Patent
Chiang

(10) Patent No.: US 6,561,184 B2
(45) Date of Patent: May 13, 2003

(54) NOSE CLIP

(76) Inventor: Herman Chiang, 11 F-2 No. 634-9 Ching-Ping Rd., Chung-Ho City Taipei Hsien (TW)

( * ) Notice: Subject to any disclaimer, the term of this patent is extended or adjusted under 35 U.S.C. 154(b) by 105 days.

(21) Appl. No.: 09/757,238

(22) Filed: Jan. 8, 2001

(65) Prior Publication Data

US 2002/0124844 A1 Sep. 12, 2002

(51) Int. Cl.[7] ..... A62B 18/02
(52) U.S. Cl. ..... 128/201.18; 128/858
(58) Field of Search ..... 128/201.18, 204.12, 128/207.13, 207.18, 858, 843

(56) References Cited

U.S. PATENT DOCUMENTS 598,467 A * 2/1898 Carence ..... 128/201.18
640,629 A * 1/1900 Carence ..... 128/201.18
690,663 A * 1/1902 Pratt ..... 128/201.18
2,015,617 A * 9/1935 Claudius ..... 128/201.18
2,274,997 A * 3/1942 Thurman ..... 128/201.18
2,488,616 A * 11/1949 Browne ..... 128/201.18
2,757,665 A * 8/1956 Tanikawa ..... 128/201.18
3,802,426 A * 4/1974 Sakamoto ..... 128/204.12
4,231,360 A * 11/1980 Zloczysti et al. ..... 128/201.18
5,103,813 A * 4/1992 Hart et al. ..... 128/201.18
5,533,504 A * 7/1996 Stamos ..... 128/201.18
5,983,898 A * 11/1999 Doyle ..... 128/858

* cited by examiner

*Primary Examiner*—Dennis Ruhl
*Assistant Examiner*—Joseph F. Weiss
(74) *Attorney, Agent, or Firm*—Troxell Law Office PLLC

(57) ABSTRACT

This invention is a nose clip, to be clipped onto a user's nose to prevent pool water from entering the user's nasal cavity, the nose clip comprising a main body, the main body having two clipping arms that are joined as one unit by connecting part, and two clipping parts on two clipping arms, and two flexible pads located at the clipping parts, characterized in that, the clipping arms are formed as inclined arches from the clipping parts to the connecting part. The clipping parts have an assembling groove to facilitate assembly of the flexible pads. The arched clipping arms enables comfortable contact with the nose ridge, providing comfortable clipping effect when the nose clip is clipped onto the wings of the nose, suitable for users with different shapes of nose.

8 Claims, 8 Drawing Sheets

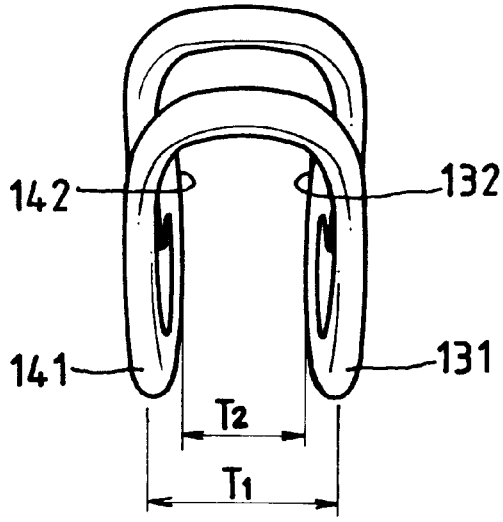
*FIG.8* A
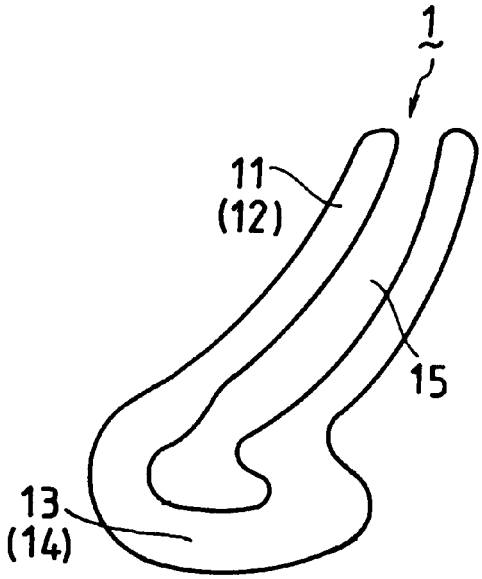
*FIG.8* B

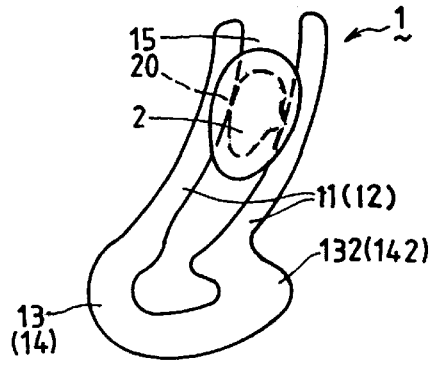
*FIG.9* A
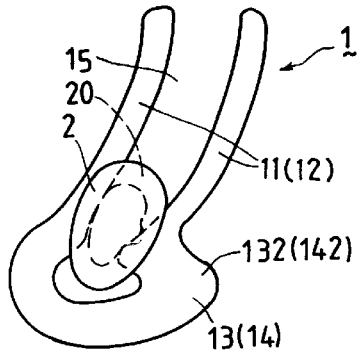
*FIG.9* B
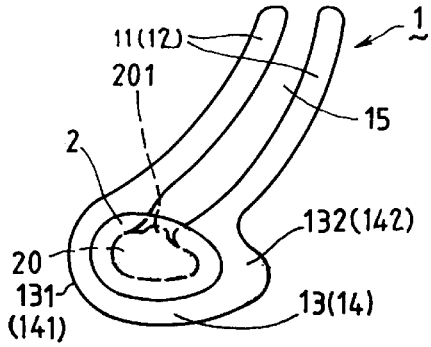
*FIG.9* C

NOSE CLIP

BACKGROUND OF THE INVENTION

1. Field of the Invention

This invention relates to a nose clip, particularly a nose clip that is clipped onto a swimmer's nose to prevent pool water from flowing into the user's nasal cavity. The innovative construction of the nose clip is designed ergonomically and has an appropriate clipping force to provide comfortable clipping effect.

2. Background of the Invention

Nose clips are often used by swimmers to prevent pool water from entering the swimmer's nasal cavity. In general, water ballerinas or begining swimmers who do not know how to control breathing while swimming often use nose clips. The construction of the nose clip is designed to provide clipping purpose. Meanwhile, the clipping force shall not cause discomfort. The conventional nose clips are designed in a U-shaped construction, which can be clipped on two sides of the nose. However, there are shortcomings in the conventional nose clips as follows: (Please refer to FIGS. 1 through 5.)

FIG. 1 shows a nose clip 8 as a single U-shape unit formed by one-piece plastic. The two sides of the U shape are the clipping arms 80 (81). The ends of the two clipping arms 80 (81) are designed in disk shapes that can be clipped onto the wings on two sides of the nose. Because of its U shape formation requiring sufficient clipping force for clipping purpose, the material to be used is quite rigid. As a result, the one-piece nose clip has a rigid clipping force with poor flexibility, causing discomfort when it is worn on the user's nose.

FIG. 2 shows a nose clip 7 that is made of metal material bent to a U shape, with latex rubber coating on the outside. Closing to the ends of the two clipping arms 70 (71) are vertical positioning posts 72 to fix a headband 73. Though the construction of such nose clip 7 involves flexible latex rubber in contact with the nose wings, its formation of plate metal bent to form results in rigidity of the two clipping arms 70 (71). Therefore the nose clip becomes too stiff when it is worn on the nose. Furthermore, there is difficulty in stretching the nose clip and ill comfort when it is clipped on the nose wings.

FIG. 3 shows a nose clip 6 that is made of metal material bent to form. It is made of a fine metal strip that is bent to shape, having connecting part 60 and two J-shaped clipping arms 61 (62). On the two clipping arms 61 (62) is the coating of a larger area of latex rubber 63. Such a construction is quite different from the two conventional types of nose clip 8, 7. In addition to some improvement on the rigidity of clipping force, they have better comfort. However, when the nose clip 6 is clipped on the user's nose wings, the connecting part 60 is located below the nostril. And because everyone's nose shape is different, the constant height of the connecting part 60 is different because of the different clipping positions of the two clipping arms 61 (62) to suit different nose shapes. If a larger nose shape is limited by the connecting part 60, the clipping position of the two clipping arms 61 (62) does not provide better comfort. In other words, if comfort is required for the conventional nose clips to suit different nose shapes, there shall be various sizes and specifications, which will bring some problems in the management of supplies.

FIG. 4 shows a nose clip 5 having two J-shaped clipping arms 50, 51 and connecting part 52. However, its clipping method is the opposite of the above nose clip 6. The connecting part 52 is riding across the nose ridge; the connecting part 52 is suitable for a larger nose shape, so it is designed to incline upwards to the front. Though the rubber cap 53 at the front ends of the clipping arms 50, 51 can provide comfort when the nose clip is clipped to the nose wings, it can fall off easily. As shown in FIG. 4, because the rubber cap 53 is fitted downward to the ends of the two clipping arms 50, 51 and the nose clip is put on in the direction opposite to the installation of the rubber cap 53, it can easily be pushed out when putting on the nose clip, resulting in an inconvenience in its use. So it is evident from the above construction and shortcoming description of conventional nose clips that the shortcomings of conventional nose clips consist in the rigid clipping force and the discomfort to the nose caused by the clipping. Furthermore, due to the restriction in the structure of conventional nose clips, they are not suitable for different nose shapes.

SUMMARY OF THE INVENTION

The main objective of this invention of nose clip is to provide a nose clip with excellent clipping force and comfortable clipping effect. The specially designed arch of the nose clip provides the required clipping force, while the flexible material of the nose clip enables better contact with the nose, prevents it from falling off, and ensures comfortable clipping position on the nose wings.

Another objective of the invention is to provide an ergonomically designed nose clip, the configuration of the nose clip enabling natural contact with the nose ridge, therefore, one size will be able to fit different nose shapes of different users.

The invention of nose clip comprises two clipping arms and a connecting part joining the two clipping arms. There is one clipping part each of the two clipping arms which are shaped as inclined arches from the clipping part to the connecting part, so the connecting part can naturally be in close contact with the arch of the nose ridge.

Another characteristic of the nose clip lies in that: The clipping parts have an assembling groove that enables firm assembly of the flexible pads, and provide comfortable clipping effects of the nose clip on the nose wings.

Yet another characteristic of the nose clip lies in that: The clipping parts include the first end located on the side of the assembling groove, and the second end located on the other side of the assembling groove, where the first end extends in the direction away from the second end, providing the clipping parts with a larger area, so the contact area between the nose and the nose clip can be enlarged to provide better comfort.

Yet another characteristic of the nose clip lies in that: There is a locating groove on the rim of the flexible pad that can be fitted to the assembling groove to provide effective positioning effect.

BRIEF DESCRIPTION OF DRAWINGS

The drawings of preferred embodiments of this invention are described in following details to enable better understanding, wherein:

FIGS. 8A and 8B are front view and right side views of FIG. 6 before the pads are assembled;

FIGS. 9A, 9B and 9C illustrate how the flexible pads are assembled to the main body of the invention;

BRIEF DESCRIPTION OF NUMERALS

| | | | |
|---|---|---|---|
| 1 | nose clip | 10 | main body |
| 11, 12 | clipping arm | 13, 14 | clipping part |
| 131, 141 | first end | 132, 142 | second end |
| 15 | assembling groove | 16 | connecting part |
| 2 | flexible pad | 20 | positioning groove |
| 201 | stop salient | | |

DETAILED DESCRIPTION OF PREFERRED EMBODIMENTS

Figure 1:
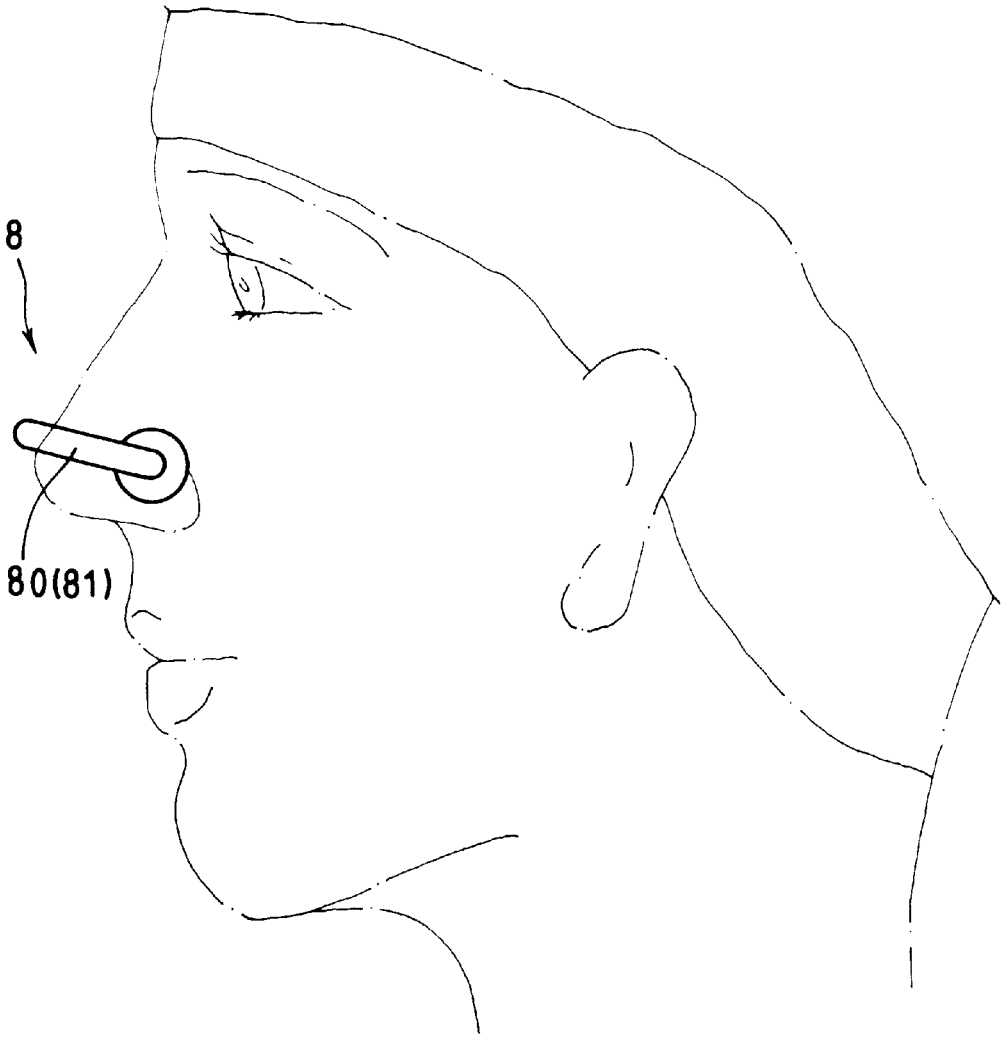
FIG.1 PRIOR ART
FIGS. 1 through 5 illustrates how a conventional nose clip is in use, as well as its disassembled and assembled view.
Figure 2:
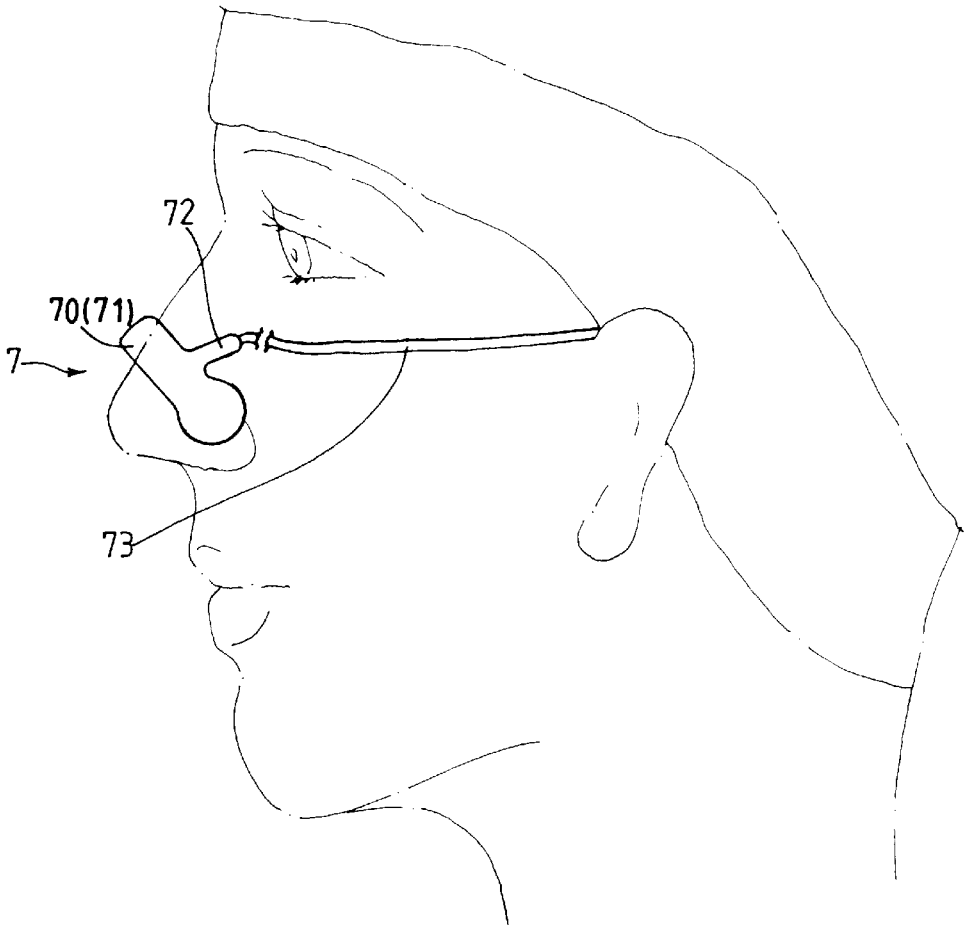
FIG.2 PRIOR ART
Figure 3:
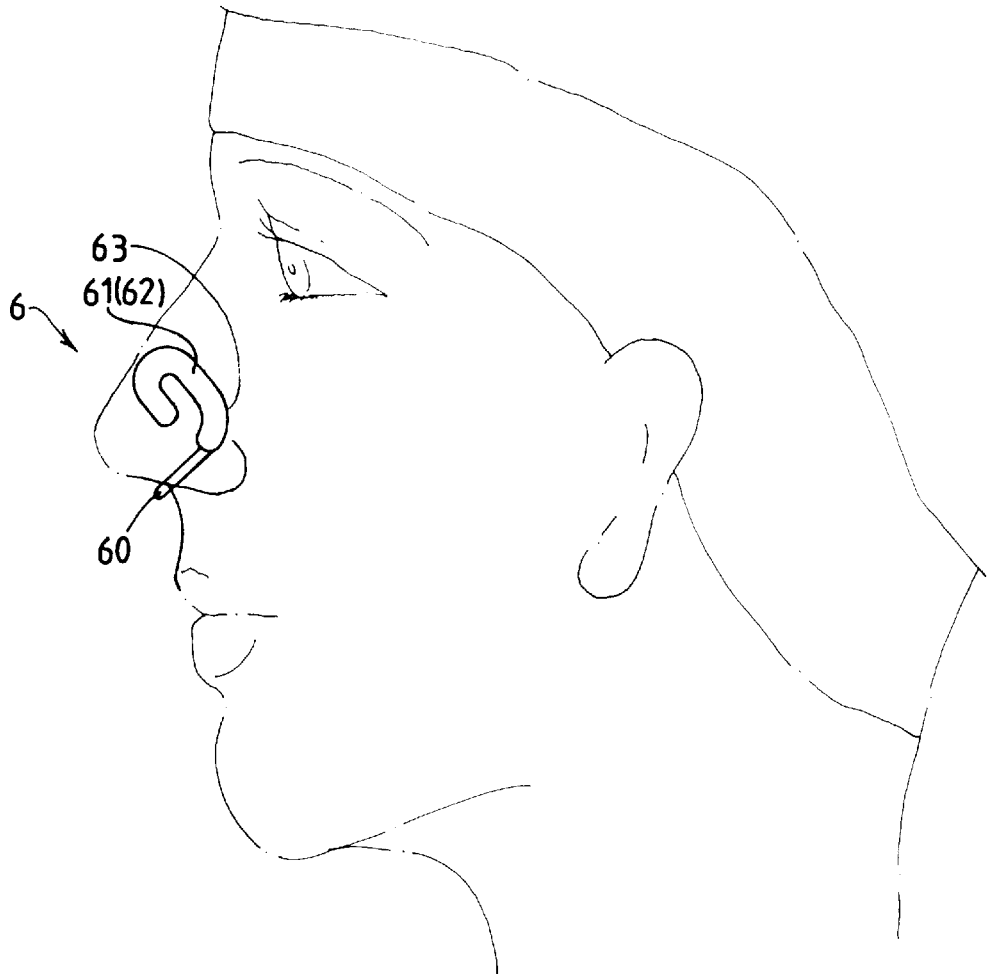
FIG.3 PRIOR ART
Figure 4:
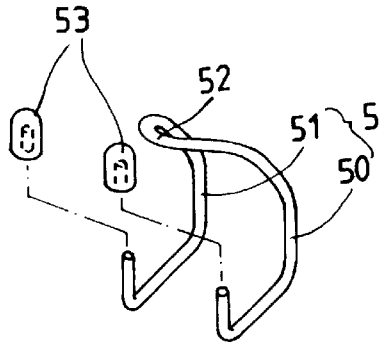
FIG.4 PRIOR ART
Figure 5:
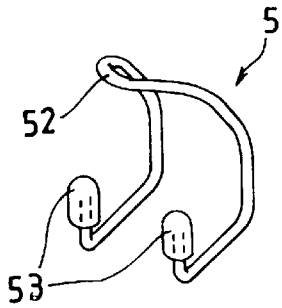
FIG.5 PRIOR ART
Figure 6:
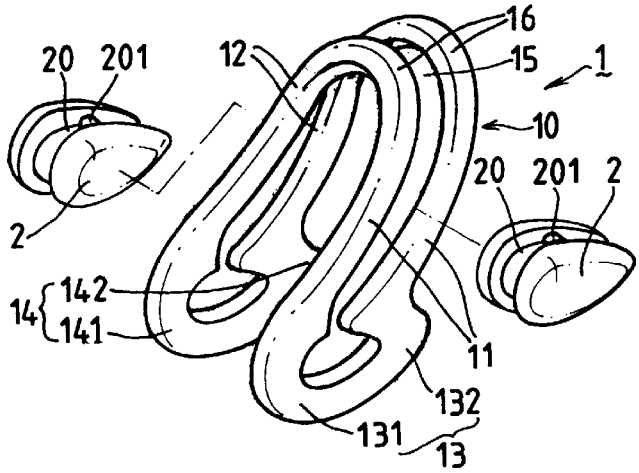
FIGS. 6 and 7 are disassembled and assembled views of the invention.
Figure 7:
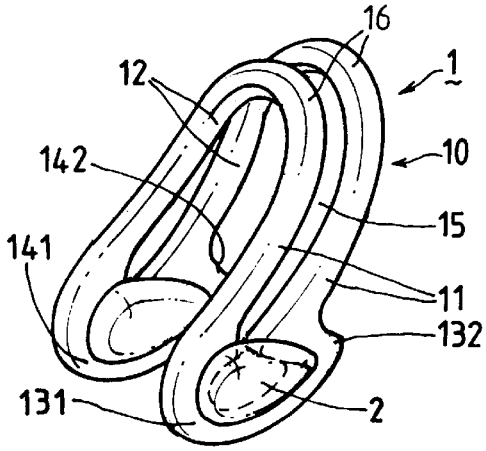

As shown in FIGS. 6 and 7, this invention of nose clip 1 comprises a main body 10, the main body is made of one-piece formed plastic material, having two clipping arms 11, 12, a connecting part 16 and two clipping parts 13, 14. The clipping parts 13, 14 are assembled with a flexible pad 2, respectively. The two clipping arms 11, 12 formed with inclined arches respectively extend from the clipping parts 13, 14 to the connecting part 16. There is an assembling groove 15 defined with two opposed sides, set on the two clipping arms 11, 12 and clipping parts 13, 14, and runs from the clipping part 13 at one end to the other clipping part 14 at the other end. Meanwhile, the assembling groove 15 extends along said clipping arms 11, 12 to reach the clipping parts 13, 14. The clipping parts 13, 14 respectively comprise two first ends 131, 141 located adjacent to one of the opposed sides of the assembling groove 15, and two second ends 132, 142 located adjacent to the other side of the assembling groove 15. The second ends 132, 142 are opposed away from the first ends 131, 141, so the areas of the clipping parts 13, 14 are enlarged. The area of the assembling groove 15 inside the framed of the clipping parts 13, 14 is relatively large and, therefore, can locate a pair of flexible pads 2 in similar structure and shape into and is slide on along the assembling groove 15, on the clipping arms 11, 12 to reach the clipping parts 13, 14, thereby providing a larger and more comfortable contact area. The pair of flexible pads 2 each with opposite rims and a locating groove 20 are respectively installed onto and then securely slide on along the assembling groove 15 to reach the clipping part 13, 14 by means that the opposite rims of each pad 2 are protruded out of the assembling groove 15 in bi-directions and the corresponding locating groove 20 accommodates a rim formed with each side of the assembling groove 15 to prevent the rim of assembling groove 15 from displacing out where is between the opposite rims of the each pad 2 to provide a comfortable clipping effect. Defined between the rims of the flexible pad 2 is the positioning groove 20 that can be fitted to the rim of the assembling groove 15 for effective positioning effect (to be described later). In the positioning groove 20 and opposite the assembling groove 15 is a stop salient 201 that serves to prevent dislocation of the flexible pad 2 after the pad 2 is assembled. The height of the connecting part 16 on the side of the assembling groove 15 along the first ends 131, 141 is lower than the height of the connecting part 16 on the other side of the assembling groove 15 along the second ends 132, 142, so that the opposed sides of the assembling groove 15 on the clipping arms 11, 12 will be arranged in vertical direction and suit the incline of the user's nose ridge in an up-to-down way when the nose clip is clipping on his/her nose.

As shown in FIG. 8A, the distance T2 between the second ends 132, 142 located at the clipping parts 13, 14 of the two clipping arms 11, 12 is shorter than the distance T1 between the first ends 131, 141. It is so designed that the distance T2 between the second ends 132, 142 will enable effective and steady clipping on the nose wings. As shown in FIG. 8B, the area of the clipping part 13 (14) of the nose clip 1 is quite large; the side view configuration thus formed with the two clipping arms 11, 12 is similar to the side view of a nose, so it enables smooth and comfortable contact with the nose.

Figure 10:
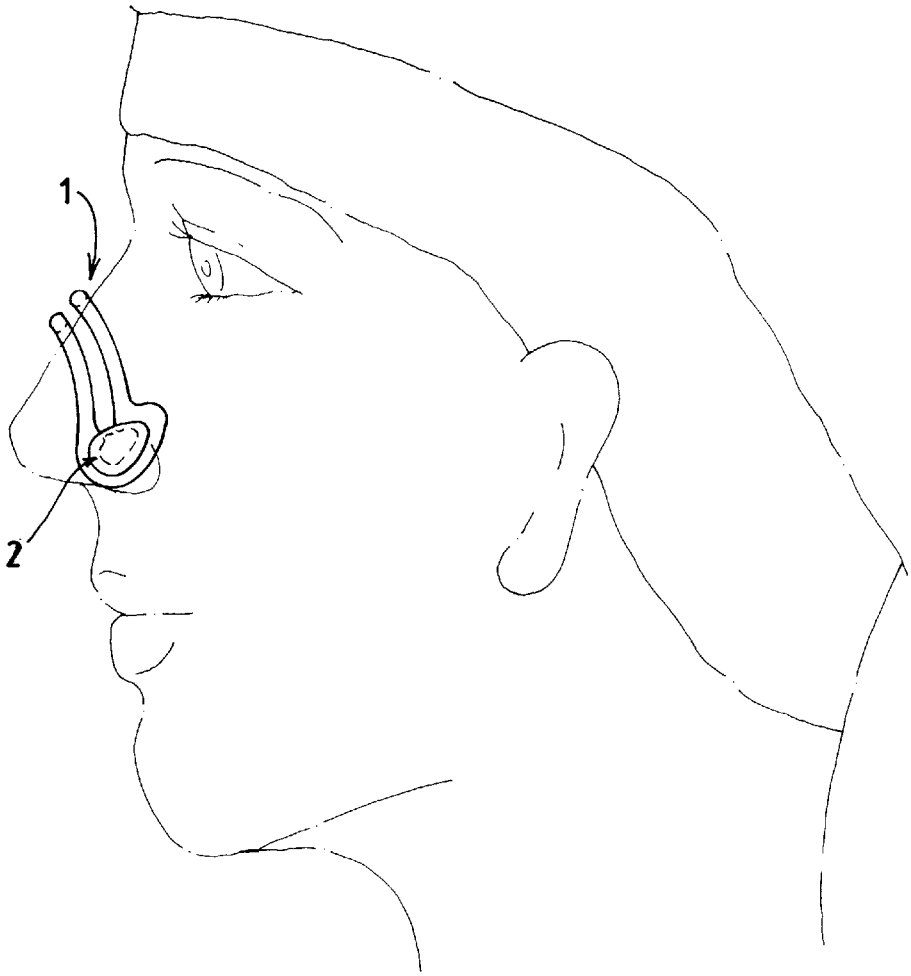
FIG. 10 is an embodiment view of the invention of nose clip worn on a user's nose.

As shown in FIGS. 9A, 9B and 9C, the flexible pad 2 is assembled in a way that, First, the flexible pad 2 is snapped into the assembling groove 15 as shown in FIG. 9A, so the positioning groove 20 is embedded on the two clipping arms 11 (12). Next, as in FIG. 9B, the flexible pad 2 is moved down along the assembling groove 15 toward the second end 132 (142) of the clipping part 13 (14), and then it is firmly embedded as one unit with the clipping part 13 (14), as shown in FIG. 9C. At this stage, the stop salient 201 on the flexible pad 2 is properly snapped on the assembling groove 15 to prevent the flexible pad 2 from dislocation. After the assembly, the nose clip can be clipped on the nose wings, as shown in FIG. 10. Since a large area of the flexible pad 2 is in contact with the nose wings, it will provide comfortable clipping effects. Besides, there is no risk of falling off because the flexible pad 2 is embedded in position in the assembly.

As can be evidenced above, this invention of nose clip is capable of serving its anticipated purpose. However, the above descriptions cover only the preferred embodiment of the invention. It is to be understood that all modifications and variations deriving from this invention shall be included in the subject claim.

What is claimed is:

1. A nose clip to be clipped on a user's nose to prevent pool water from entering the user's nose cavity, comprising:

two clipping arms shaped with inclined arch, having a clipping part at an end of each clipping arm;

a connecting part at an opposite end of each clipping arm corresponding to the clipping part, serving to join the two clipping arms as one unit; and at least an assembling groove defined with two opposed sides on one of the clipping parts for respectively accommodating a pair of flexible pads;

wherein each of said clipping parts further includes a first end located adjacent to one of the opposed sides of the assembling groove, and a second end located adjacent to the other side of the assembling groove thereby defining as an accommodating area for the corresponding flexible pad, and when putting on the nose clip to provide better comfort effect and make it suitable for users with different nose shapes, said side of the assembling groove with the first ends is away from the user's nose ridge but the other side of the assembling groove with the second ends is close to the user's nose ridge whereby the height of the side of the assembling groove with the first ends is lower than the height of the said opposite side of the assembling groove with the second ends so as to constitute a vertical arrangement of the opposed sides of the assembling groove on the clipping arms in compliance with an up-to-down curve of the user's nose ridge for said better contact with users with different nose shapes.

2. The nose clip as claimed in claim 1, wherein the distance between the two second respectively located on the two clipping arms is less than the distance between the two first ends respectively located on the two clipping arms so as to comfortably secure the nose clip onto the user's wings of the nose.

3. The nose clip as claimed in claim 1, wherein a pair of opposed rims are formed on each flexible pad with a locating groove that can be into by a rim formed along each sides of the assembling groove whereby in the assembling process, the flexible pad can slide onto the assembling groove of the clipping parts to be positioned effectively with cooperation between the rim of the assembling groove and the locating groove of the flexible pad, by actuating a pushing force on the flexible pad along the assembling groove on the clipping arms to reach the clipping part.

4. The nose clip as claimed in claim 3, wherein after the flexible pads are forced to reach the assembling groove of the clipping parts, on each of the positioning groove opposite to the assembling groove of the clipping arms is a stop salient designed to prevent the flexible pad from displacement.

5. The nose clip as claimed in claim 3, wherein the flexible pads are made of rubber material, and one side thereof in contact with the user's nose is slightly protruded out of the assembly groove in the clipping part to form an arched face.

6. A nose clip that is worn on a user's nose to prevent water from flowing into the user's nasal cavity, the said nose clip comprising: a main body which has two clipping arms and a clipping part at one end of each clipping arm, characterized in that: there is at least an assembling groove extended along said clipping arms to reach the clipping parts, and a pair of flexible pads each with opposite rims and a locating groove are respectively installed onto and then securely slide on along the assembling groove to reach the clipping part by means that the opposite rims of each pad are protruded out of the said assembling groove in different directions and the corresponding locating groove accommodates a rim formed with each side of the assembling groove to prevent the rim of assembling groove from displacing out where is between the opposite rims of the each pad to provide a comfortable clipping effect.

7. The nose clip as claimed in claim 6, wherein after the flexible pads are forced to reach the assembling groove of the clipping parts, on the positioning groove opposite to the assembling groove of the clipping arms are a stop salient to prevent the flexible pads from dislocating.

8. The nose clip as claimed in claim 7, wherein the said flexible pads are made of rubber material, one side of the flexible pad in contact with the nose being slightly protruded to become an arched face.

* * * * *